United States Patent [19]

Pick et al.

[11] Patent Number: 4,473,512

[45] Date of Patent: Sep. 25, 1984

[54] SANITARY STEAM INJECTION HEATER

[75] Inventors: Alan E. Pick; Richard A. Mayo, both of West Bend, Wis.

[73] Assignee: Pick Heaters, Inc., West Bend, Wis.

[21] Appl. No.: 419,246

[22] Filed: Sep. 17, 1982

[51] Int. Cl.[3] ..... B01F 3/04

[52] U.S. Cl. ..... 261/62; 122/442; 239/417.3; 261/76; 261/DIG. 10

[58] Field of Search ..... 261/62, 76, 79 A, 36 R, 261/94, DIG. 10, DIG. 32; 366/339; 426/511; 122/442; 239/417.3, 432

[56] References Cited

U.S. PATENT DOCUMENTS

| | | | |
|---|---|---|---|
| 180,345 | 7/1876 | Hughes | 261/DIG. 10 |
| 406,290 | 7/1889 | Murdock | 261/62 X |
| 532,374 | 1/1895 | Hermes | 261/76 X |
| 929,050 | 7/1909 | Sweeny et al. | 261/DIG. 10 |
| 2,009,577 | 7/1935 | Coppus | 122/442 |
| 2,151,125 | 3/1939 | Lewis | 122/442 |
| 2,455,498 | 12/1948 | Kern | 261/36 R |
| 3,984,504 | 10/1976 | Pick | 261/76 |
| 4,112,131 | 9/1978 | Bosy et al. | 426/511 X |
| 4,237,620 | 12/1980 | Black | 261/79 A X |

FOREIGN PATENT DOCUMENTS

| | | | |
|---|---|---|---|
| 2104219 | 8/1972 | Fed. Rep. of Germany | 366/339 |
| 828444 | 5/1938 | France | 261/62 |
| 18088 | 11/1916 | United Kingdom | 261/62 |

*Primary Examiner*—Richard L. Chiesa

*Attorney, Agent, or Firm*—Fuller, House & Hohenfeldt

[57] ABSTRACT

A skeletonized piston assembly in which a tube forms a piston shank and an enlarged thin disc has a peripheral edge which provides the piston skirt. A guide disc is spaced from the other disc and guides movement of the piston. Quick release fittings and a removable helical flight assembly adapt the heater for sanitary applications and easy clean-out.

6 Claims, 4 Drawing Figures

SANITARY STEAM INJECTION HEATER

BACKGROUND OF THE INVENTION

The invention relates to a steam injection heater of the type disclosed in U.S. Pat. No. 2,455,498 and U.S. Pat. No. 3,984,504. These heaters are desirably provided with a steam regulating piston as disclosed in these patents. When using the heater to heat slurries with solids with large particle sizes, the solids can enter the space between the piston skirt and cooperating chamber wall to interfere with smooth operation of the piston. The heaters illustrated in the foregoing patents also are not specifically designed for sanitary heating applications. The components cannot be readily disassembled for cleaning purposes.

SUMMARY OF THE INVENTION

The invention provides a steam regulating piston which is less susceptible to interference from particles and a sanitary construction. The piston employs an annular disc secured at the end of a tube for the operative element of the piston, with the peripheral surface of the disc forming the piston skirt. The thin skirt with a small axial or longitudinal extend minimizes retention of large particles in the space between the piston and chamber wall. It also renders the heater particularly appropriate for processing food slurries which contain semi-solids. The piston is guided for rectilinear movement by a guide disc which is secured to the tube remote from the piston disc. The guide disc does not fully occupy the cross-section of the steam chamber and this permits pass-through of solids. The guide disc prevents tumbling of the piston and does contact the chamber wall at one or more points to guide the piston. The piston tube also serves as a locator and connector for the coil spring which biases the piston to a closed position.

Other features of the invention which make the heater particularly suitable for sanitary heating applications include a separable helical flight assembly which contains multiple ribbons which are located proximate the inside periphery of the cylindrical casing of the heater. The flight assembly interrupts laminar flow of the slurry to insure uniform heating as disclosed in the foregoing patents. The ribbons extend in a helical path between two washer-shaped discs which serve as connectors to connect the individual ribbons or flights. The separable helical flight assembly enables easy removal for cleaning. Other clean-out features include easy piston removal in which the steam injection tube is provided with a spring abutment or stop which is held in place by a pin which can be removed to release and remove the piston, spring and spring abutment. The sanitary heater is also adapted to use quick clamp fittings or sanitary threaded parts to facilitate rapid sanitary clean-out and disassembly.

Further objects, features and advantages of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
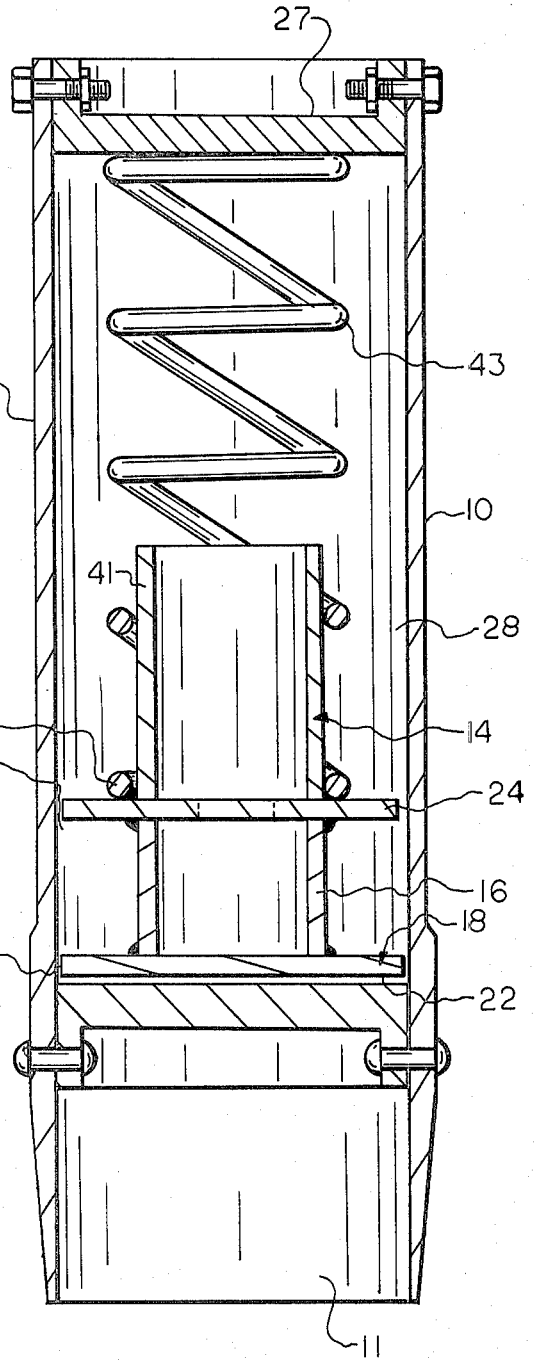
FIG. 1 is a diagrammatic side elevational view of a steam injection tube with the new piston of the invention.
Figure 2:
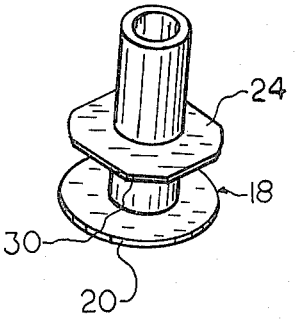
FIG. 2 is a perspective view on a reduced scale of the piston illustrated in FIG. 1.
Figure 3:
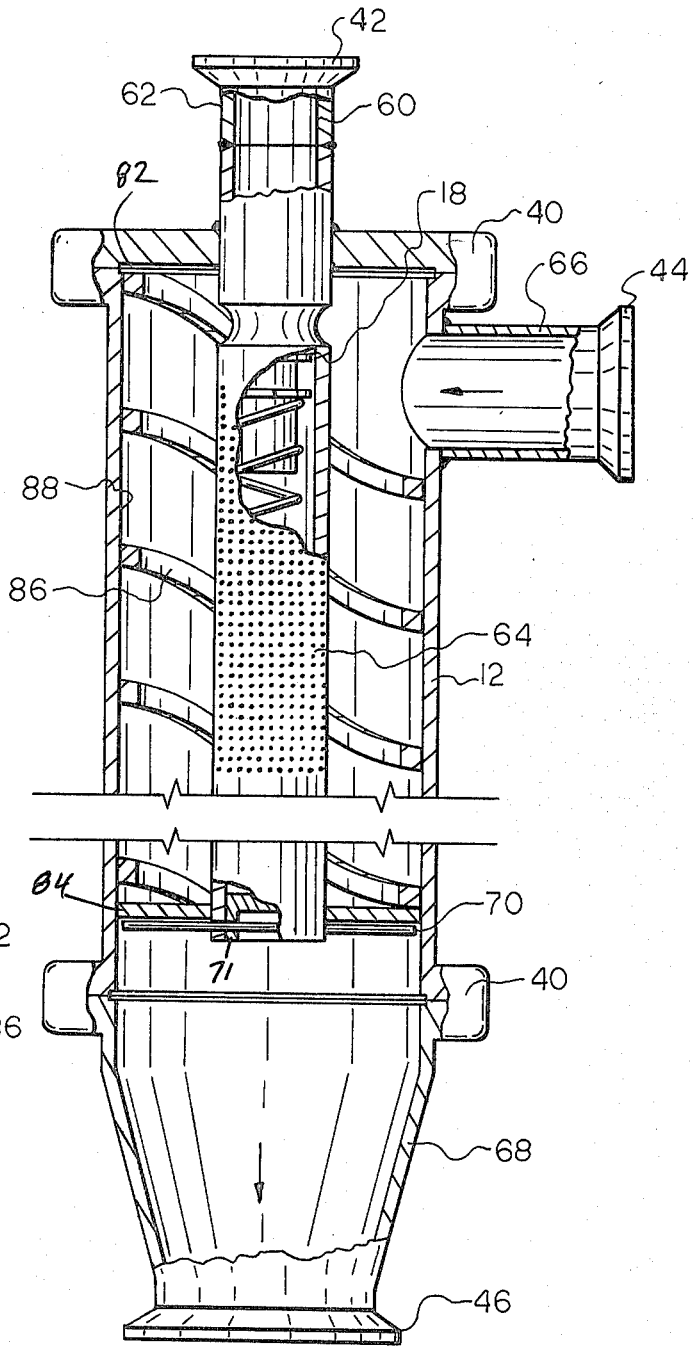
FIG. 3 is a side elevational view in fragmentary section of a heater particularly adapted for sanitary applications and including the piston illustrated in FIG. 1.

FIG. 1 discloses a steam injection tube 10 which can be of the type illustrated in U.S. Pat No. 3,984,504 or U.S. Pat. No. 2,455,498, the entire disclosures of which are incorporated herein by reference. The steam injector tube 10 is contained in the interior of a larger diameter casing or housing such as 12, as illustrated in FIG. 3. The steam injection tube 10 has an inlet 11 and foraminous or perforated cylindrical wall 13 to allow escape of steam to intermix with the slurry being heated, which moves continuously in the annular space between the casing 12 and the injection heater tube 10 between the casing inlet 11 and outlet (not shown in FIG. 1).

The steam injection tube includes a skeletonized piston assembly 14 for the purposes disclosed in U.S. Pat. No. 2,455,498 which acts to restrict the length of the injector tube which is being employed to discharge steam and a hence the number of orifices that are involved in steam injection. The piston moves as the spring expands or contracts due to increased or decreased pressure on the piston. This maintains a pressure differential and avoids a pressure equilibrium between the fluids outside the steam injector tube and the steam in the tube which can cause alternating surges of steam and pressure which can produce shock vibration, hammering and noise.

In accordance with the invention, the piston assembly 14 includes a tubular member 16 and an annular disc or head disc 18 located at one end thereof, with the disc 18 having a peripheral surface 20 which acts as a piston skirt and a planar surface 22 which forms the head surface of the piston. An intermediate guide disc 24 functions as an abutment for one end 26 of spring 43 and also cooperates with the disc 18 to guide the piston for rectilinear travel in the interior 28 of the steam injector tube 10. The other end of spring 43 can be restrained by an abutment 27 or cup (not shown) held in place by bolts. The disc 24 can have one or more relieved portions or non-concentric surfaces such as the corner 30 which permits pass-through of solids in the gap 32 between the inner surface of the injector tube and the periphery of the disc. Other configurations of the guide disc can be employed. The disc 24 desirably occupies less cross-sectional area than the disc 18. The pass-through of solids prevents interference with free movement of the piston in response to variations in steam pressure. The piston tube end 41 serves as a locator and support for the end of biasing spring 43 which urges the piston to the FIG. 1 position.

The minimal axial extent of the peripheral surface 20 minimizes the retention possibilities of solid particles between the piston skirt and wall as compared with a full length piston skirt.

FIG. 3 illustrates a steam injector heater which is particularly adapted for sanitary applications because of easy clean-out capabilities and includes quick disconnect couplings 40 at each end, sanitary threads at 42, 44 and 46 for quick disconnect and other clean-out features presently described. The casing 12 is shown with the steam tube in an inverted position as compared with the steam injector tube in FIG. 1. The heater (FIG. 3) can be employed in either vertical position or horizontally. It includes a steam injector tube 60 with a steam inlet 62 and a foraminous cylindrical wall 64. A foraminous diffusion screen as illustrated in U.S. Pat. No. 3,983,504 and designated 50 in the drawings of that patent can be employed for the purposes therein described.

The heater of FIG. 3 also includes a slurry inlet 66 and a heated slurry outlet 68. The piston 18 illustrated in FIG. 1 can be employed, or a cup-shaped piston as illustrated in the above noted patents could be used. However, the piston 18 is particularly suitable for sanitary applications which would involve slurries with semi-solids or solids contained therein.

The steam injector tube 60 is provided with a quickly removable piston abutment in the form of a grid 71 held in place by a pin which holds the spring under tension against the piston. In the disclosed construction, the pin 70 extends through a transverse aperture in the injection tube. The pin and grid are easily removed to disassemble the spring and piston.

Figure 4:
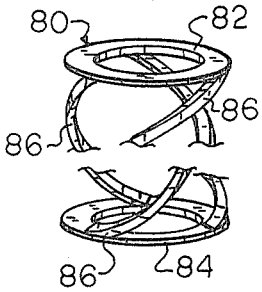
FIG. 4 is a fragmentary perspective view of the helical flight assembly shown in FIG. 3 in reduced scale.

FIG. 4 illustrates the helical flight assembly 80 of FIG. 3 which includes two end plates 82 and 84 in spaced relationship with a plurality of helically arranged ribbon flight 86 which are interconnected by the plates. As illustrated, three ribbons are employed. The helical flights 86 are located in close proximity to the interior surface 88 of the casing 12 to cause turbulence and intermixing of the slurry being heated to avoid localized heating adjacent the injection tube which could cause scaling. Turbulent flow as opposed to laminar flow also provides uniform cooking of the slurry. The helical flight assembly is easily disassembled from the casing for cleaning purposes.

The heater shown in FIG. 3 can be made of stainless steel parts with sanitary fittings. It can be used in the pulp and paper industry, the drug and cosmetic industry and generally for semi-solid aqueous products. In the food industry it can be used with various food products, including dairy products.

Other modifications, such as substitution of a solid rod for tube 16 are within the purview of the invention.

We claim:

1. In a steam injection liquid heater having a heating chamber, inlet means to supply liquid to said heating chamber and a foraminous steam injection tube within said heating chamber for injecting steam jets from the steam injection tube into liquid in said heating chamber to heat the same comprising a cylindrical steam chamber, a piston assembly within the steam chamber and adapted to move along the steam chamber in response to steam pressure and open a variable number of orifices, and means to bias said piston assembly in one direction, the improvement wherein said piston assembly has a shank portion and head disc, said disc having a peripheral surface generally concentric with the interior surface of said cylindrical steam chamber and slightly spaced therefrom to afford pass-through of steam and solids between said peripheral surface and said interior surface of said steam chamber.

2. The improvement of claim 1 wherein said piston assembly includes a transversely extending guide disc longitudinally spaced from said head disc and in guiding relationship with said interior surface of said steam chamber.

3. The improvement of claim 2 wherein said guide disc occupies less cross-sectional area than said head disc to permit pass-through of solids which reach the space between said discs.

4. The improvement of claim 2 wherein said shank portion comprises a tube and said guide disc is spaced from the end of said tube, and wherein said means to bias said piston assembly comprises a spring having an end supported on said tube abutting said guide disc.

5. In a steam injection liquid heater having a heating chamber, inlet means to supply liquid to said heating chamber and a foraminous steam injection tube within said heating chamber for injecting steam jets from the steam injection tube into liquid in said heating chamber to heat the same comprising a cylindrical steam chamber, a piston within the steam chamber adapted to move along the steam chamber and open a variable number of orifices, and means to bias said piston in one direction, the improvement comprising a flight assembly having longitudinally spaced end plates interconnected by at least one flight arranged in a generally helical pattern and having a hollow central core, said flight assembly being axially slidable over said injection tube and within said heating chamber.

6. The improvement of claim 5 wherein said piston has a laterally extending flange with a peripheral surface which forms the piston skirt, and wherein said piston skirt has a relatively small axial dimension compared with its lateral extent.

* * * * *